US012575669B1

(12) United States Patent
Miciano

(10) Patent No.: US 12,575,669 B1
(45) Date of Patent: Mar. 17, 2026

(54) COLLAPSIBLE BEACH TABLE AND ASSOCIATED METHOD(S)

(71) Applicant: Chris Miciano, Jacksonville, FL (US)

(72) Inventor: Chris Miciano, Jacksonville, FL (US)

( * ) Notice: Subject to any disclaimer, the term of this patent is extended or adjusted under 35 U.S.C. 154(b) by 231 days.

(21) Appl. No.: 18/496,990

(22) Filed: Oct. 30, 2023

Related U.S. Application Data

(60) Provisional application No. 63/381,319, filed on Oct. 28, 2022.

(51) Int. Cl.
*A47B 37/04* (2006.01)
*A47B 3/06* (2006.01)

(52) U.S. Cl.
CPC ..... *A47B 37/04* (2013.01); *A47B 3/06* (2013.01); *A47B 2200/0022* (2013.01)

(58) Field of Classification Search
CPC ... A47B 37/04; A47B 3/06; A47B 2200/0022; A47B 2200/1063; A47B 2003/004; A47B 13/023; A47B 13/003; A47B 13/088; A47B 13/006
USPC ..... 108/153.1, 50.12, 149, 150, 151, 162, 108/165–168, 171, 176; 135/16; 248/156
See application file for complete search history.

(56) References Cited

U.S. PATENT DOCUMENTS 1,265,516 A * 5/1918 Reck ..... A47B 3/00 108/150
1,379,129 A * 5/1921 Sejnoha ..... A47C 9/10 108/166
1,595,034 A * 8/1926 Trautschold ..... E04G 1/34 248/188.7
2,799,543 A * 7/1957 Tomaselli ..... A45B 23/00 D3/10
3,236,389 A * 2/1966 Murdock ..... A21B 3/00 D7/610
4,461,220 A * 7/1984 Wetzel ..... A47B 37/04 108/30
6,889,618 B1 * 5/2005 Gromack ..... A47B 13/088 108/151
2003/0160139 A1 * 8/2003 Camarota ..... B63B 29/06 248/188
(Continued)

FOREIGN PATENT DOCUMENTS

ES 1063437 U * 10/2006
KR 200469801 Y1 * 11/2013 ..... A47B 9/08
KR 20150003516 U * 9/2015 ..... A47B 3/06

*Primary Examiner* — Janet M Wilkens
(74) *Attorney, Agent, or Firm* — Ashkan Najafi

(57) ABSTRACT

A collapsible outdoor table includes a top surface assembly, and a bottom stabilizing assembly removably and rotatably attached to the to the top surface assembly. The bottom stabilizing assembly has an adjustable vertical length and is configured to rotatably anchor into a sand surface such that the top surface assembly is maintained at a substantially stable horizontal orientation relative to the adjustable vertical length. Without requiring tools, the top surface assembly is configured to be rotatably assembled and rotatably disassembled to the bottom stabilizing assembly. The bottom stabilizing assembly is configured to be rotatably locked in a first rotating direction to the top surface assembly. The bottom stabilizing assembly is configured to be rotatably unlocked in a second rotating direction to the top surface assembly. The first rotating direction is opposite to the second rotating direction.

13 Claims, 7 Drawing Sheets

(56) References Cited

U.S. PATENT DOCUMENTS

| | | | | |
|---|---|---|---|---|
| 2008/0196636 | A1* | 8/2008 | Lawrence | A47B 3/10<br>108/150 |
| 2010/0154848 | A1* | 6/2010 | Meibos | A45B 23/00<br>248/156 |
| 2010/0163086 | A1* | 7/2010 | Chavez | A47B 37/04<br>135/16 |
| 2015/0208634 | A1* | 7/2015 | Box | A47B 88/00<br>108/25 |
| 2017/0042321 | A1* | 2/2017 | Clause | A47B 13/003 |
| 2018/0271273 | A1* | 9/2018 | Miller | A47B 13/003 |

* cited by examiner

COLLAPSIBLE BEACH TABLE AND ASSOCIATED METHOD(S)

CROSS REFERENCE TO RELATED APPLICATIONS

This is a non-provisional patent application that claims priority to and benefit of U.S. provisional patent application No. 63/381,319 filed Oct. 28, 2022, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to outdoor tables and, more particularly, to a specially configured collapsible and adjustable outdoor table that is anchored into a sand surface and rotatably assembled/disassembled between unfolded/folded configurations, respectively, without requiring tools.

Prior Art

Going to the beach is a popular pastime for many during the summer time months. When going to the beach, people usually bring portable folding beach chairs to sit on. Typically, such chairs sit low to the ground so that the user can relax with their feet stretched out on the warm sand and/or be covered from the sun by a beach umbrella they have stuck in the sand.

Many times, people sitting on the beach want to have a nice cool drink with them while standing on the sand. Some folding beach chairs have drink holders, but usually these are limited in size and do not securely hold the beverages. Moreover, often people want to have food while they are the beach and need a flat surface to place the food on. Consequently, there is a need for portable tables that can be used on the beach.

Currently, there are portable tables that can be used on the beach. However, most of these are not appropriately sized for the low-sitting portable folding beach chairs as well as standing users. Many portable tables have fixed heights. Furthermore, many portable tables are too unstable to use on a surface such as the beach or in the windy conditions that often occur outdoors at the beach. Additionally, drinks set on such tables often tip over or simply slide off. Finally, many portable tables are not adapted to work with beach umbrellas.

Accordingly, a need remains for a specially configured collapsible and adjustable outdoor table in order to overcome at least one of the above-noted shortcomings. The exemplary embodiment(s) satisfy such a need by a specially configured collapsible and adjustable outdoor table that is convenient and easy to use, lightweight yet durable in design, versatile in its applications, and anchored into a sand surface and succinctly assembled/disassembled between unfolded/folded configurations, respectively, without requiring tools.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured collapsible and adjustable outdoor table that is anchored into a sand surface and rotatably assembled/disassembled between unfolded/folded configurations, respectively, without requiring tools. These and other objects, features, and advantages of the non-limiting exemplary embodiment(s) are provided by a collapsible outdoor table including a top surface assembly, and a bottom stabilizing assembly removably and rotatably attached to the to the top surface assembly. Advantageously, the bottom stabilizing assembly has an adjustable vertical length and is configured to rotatably anchor into a sand surface such that the top surface assembly is maintained at a substantially stable horizontal orientation relative to the adjustable vertical length. Advantageously, without requiring tools, the top surface assembly is configured to be rotatably assembled and rotatably disassembled to the bottom stabilizing assembly. Advantageously, the bottom stabilizing assembly is configured to be rotatably locked in a first rotating direction to the top surface assembly. Advantageously, the bottom stabilizing assembly is configured to be rotatably unlocked in a second rotating direction to the top surface assembly. Advantageously, the first rotating direction is opposite to the second rotating direction.

In a non-limiting exemplary embodiment, the top surface assembly includes a support surface bifurcated into a first half and a second half and having a central aperture at a junction of the first half and the second half, a plurality of hinges connected to a bottom face of the first half and the second half, respectively, and a first coupling statically connected the bottom face of the bottom stabilizing assembly. Advantageously, the first coupling is bifurcated into a first section and a second section statically affixed to the first half and the second half, respectively.

In a non-limiting exemplary embodiment, each of the first section and the second section has a semi-spherical shape and conjoined to each other at the junction of the first half and the second half.

In a non-limiting exemplary embodiment, the bottom stabilizing assembly includes a second coupling operably engaged with the first coupling. Advantageously, the first half and the second half are configured to be pivotal relative to each other when the first coupling is rotatably unlocked from the second coupling.

In a non-limiting exemplary embodiment, the second coupling includes a central circular region and a plurality of rectilinear flanges radially extended away from the central circular region. Advantageously, the rectilinear flanges are equidistantly spaced apart along a circumferential outer perimeter of the central circular region.

In a non-limiting exemplary embodiment, the hinges are spaced along the junction of the first half and the second half.

In a non-limiting exemplary embodiment, the first coupling includes a plurality of quadrants having a plurality of open bottom sides, respectively, and a plurality of friction-inducing regions contiguously disposed to the open bottom sides, respectively. Advantageously, the rectilinear flanges are configured to upwardly enter the first coupling through the open bottom sides and further configured to rotatably slide along a top face of the friction-inducing regions, respectively, such that the first coupling is locked with the second coupling.

In a non-limiting exemplary embodiment, the quadrants include a first quadrant, a second quadrant, a third quadrant, and a fourth quadrant equidistantly spaced apart from each other. Advantageously, the first quadrant and the second quadrant are located at the first section, wherein the third quadrant and the fourth quadrant are located at the second section.

In a non-limiting exemplary embodiment, the rectilinear flanges include a first rectilinear flange, a second rectilinear flange, a third rectilinear flange, and a fourth rectilinear flange.

In a non-limiting exemplary embodiment, the friction-inducing regions include a first friction-inducing region, a second friction-inducing region, a third friction-inducing region, and a fourth friction-inducing region.

In a non-limiting exemplary embodiment, the first rectilinear flange is rotatably and removably interfitted at the first friction-inducing region. Advantageously, the second rectilinear flange is rotatably and removably interfitted at the second friction-inducing region. Advantageously, the third rectilinear flange is rotatably and removably interfitted at the third friction-inducing region. Advantageously, the fourth rectilinear flange is rotatably and removably interfitted at the fourth friction-inducing region.

In a non-limiting exemplary embodiment, the bottom stabilizing assembly further includes a top rod statically affixed to the second coupling, an intermediate rod rotatably and detachably affixed to the top rod, and a bottom rod rotatably and detachably affixed to the intermediate rod.

In a non-limiting exemplary embodiment, the top rod includes a first axial bore centrally aligned with the central aperture, a pair of first apertures, a pair of first fingers protruding outwardly from the first axial bore, and an elongated and rectilinear bar removably passed through the first apertures.

In a non-limiting exemplary embodiment, the intermediate rod is rotatably connected to the top rod and includes a second axial bore vertically aligned with the first axial bore, a pair of first J-shaped lock channels located at a proximal end of the intermediate rod, a pair of second apertures situated subjacent to the first J-shaped lock channels, and a pair of second fingers protruding outwardly from the second axial bore. Advantageously, the first fingers are rotatably engaged and disengaged with the first J-shaped lock channels.

In a non-limiting exemplary embodiment, the bottom rod is rotatably connected to the intermediate rod and includes a third axial bore vertically aligned with the first axial bore, a pair of second J-shaped lock channels located at a proximal end of the bottom rod, and a tapered distal end. Advantageously, the second fingers are rotatably engaged and disengaged with the second J-shaped lock channels.

In a non-limiting exemplary embodiment, the first half lays parallel to the second half when the top surface assembly is articulated to a folded position and an unfolded position.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
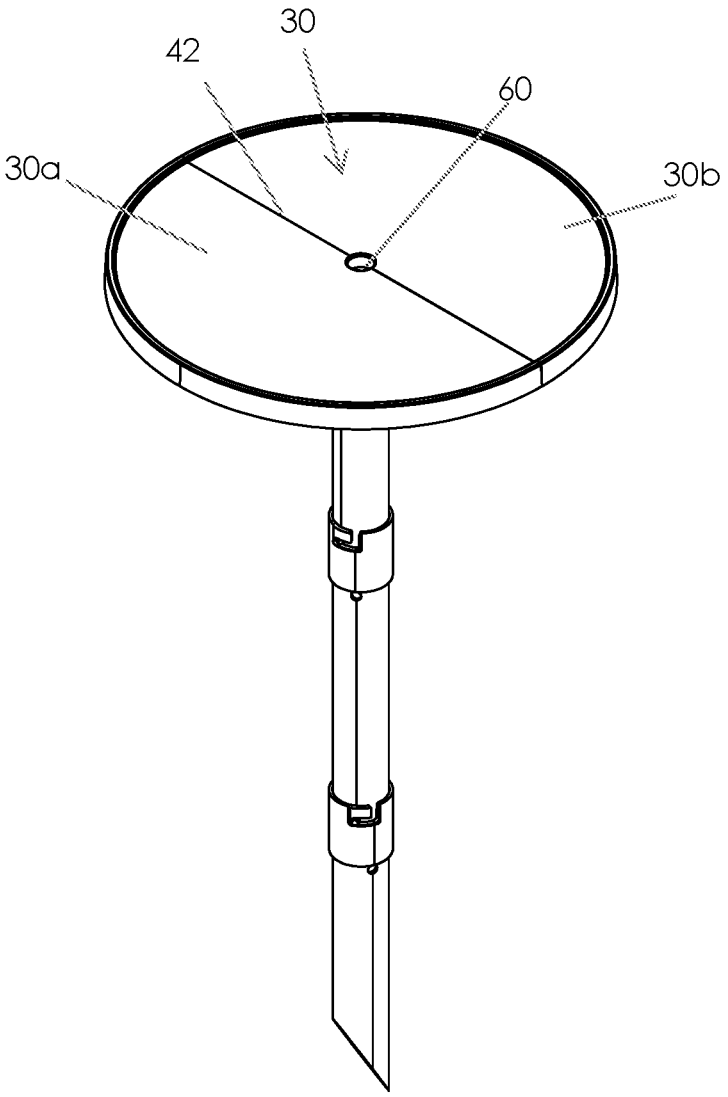
FIG. 1 is a perspective view of an adjustable beach table, in accordance with a non-limiting exemplary embodiment of the present disclosure.
Figure 2:
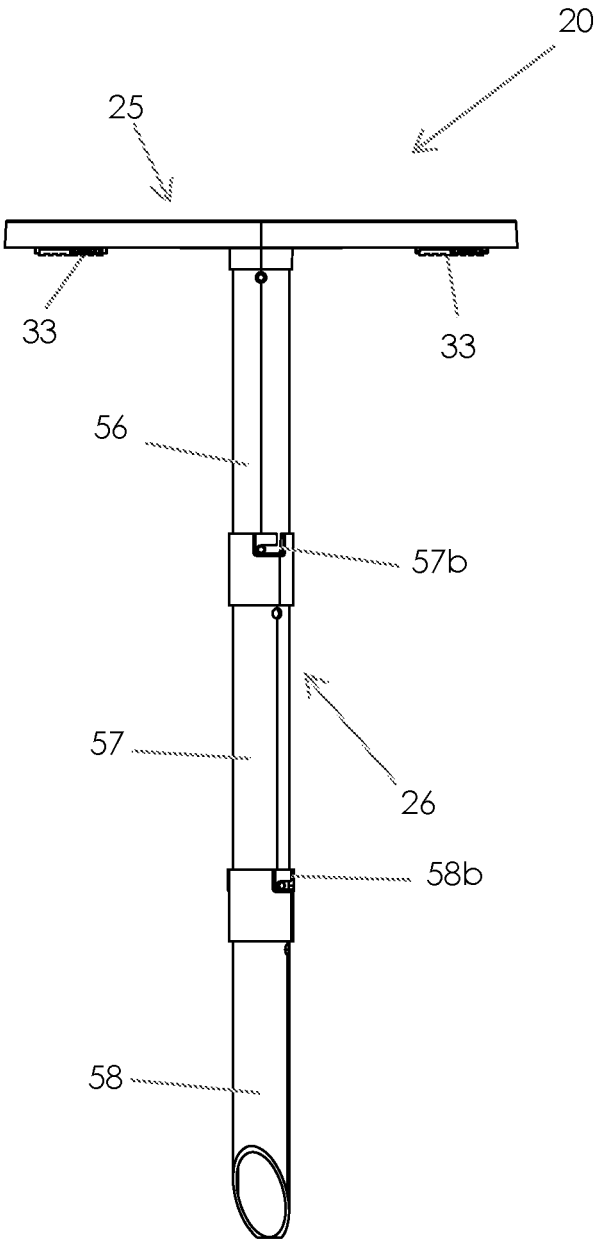
FIG. 2 is a side elevational view of the adjustable beach table shown in FIG. 1.
Figure 3:
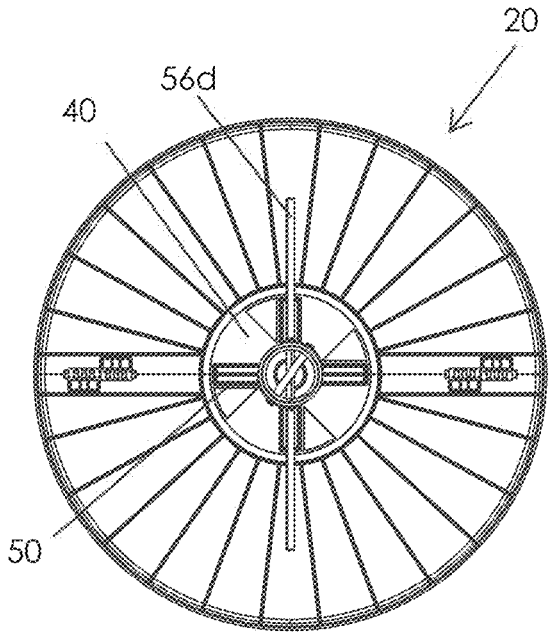
FIG. 3 is a bottom plan view of the adjustable beach table shown in FIG. 1.
Figure 4:
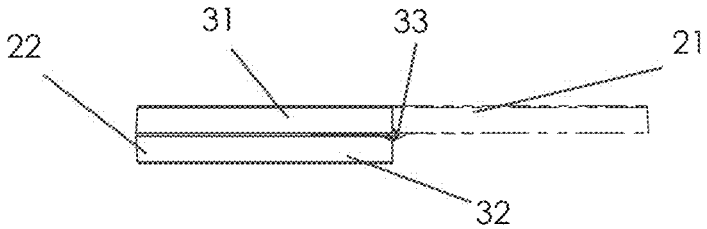
FIG. 4 is a side elevational view of the top surface assembly at a folded position.
Figure 5:
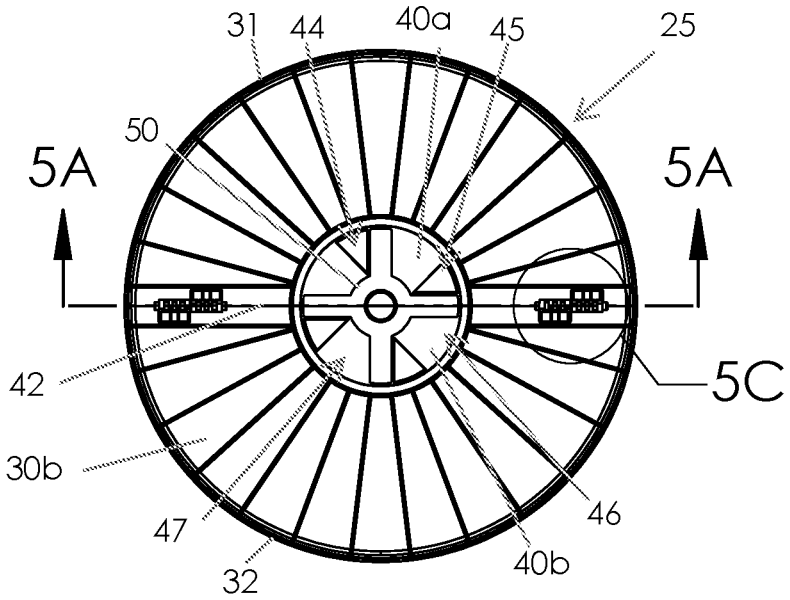
FIG. 5 is a bottom plan view of the adjustable beach table shown in FIG. 1 without the bottom stabilizing assembly.
Figure 5A:
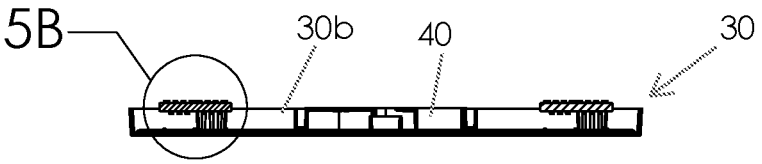
FIG. 5A is a cross-sectional view taken along line 5A-5A in FIG. 5.
Figure 5B:
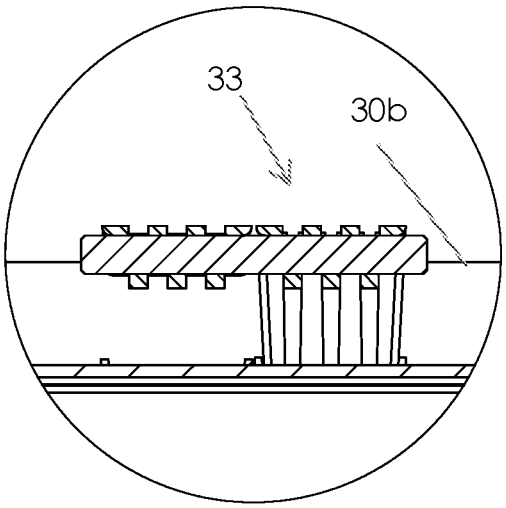
FIG. 5B is an enlarged view of section 5B taken in FIG. 5A.
Figure 5C:
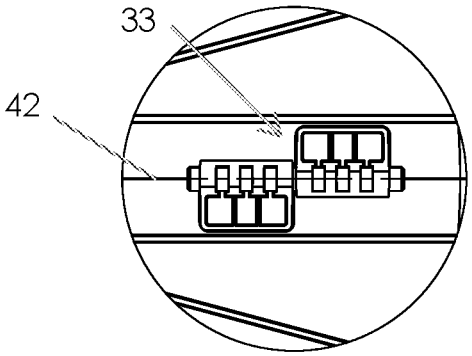
FIG. 5C is an enlarged view of section 5C taken in FIG. 5B.
Figure 6:
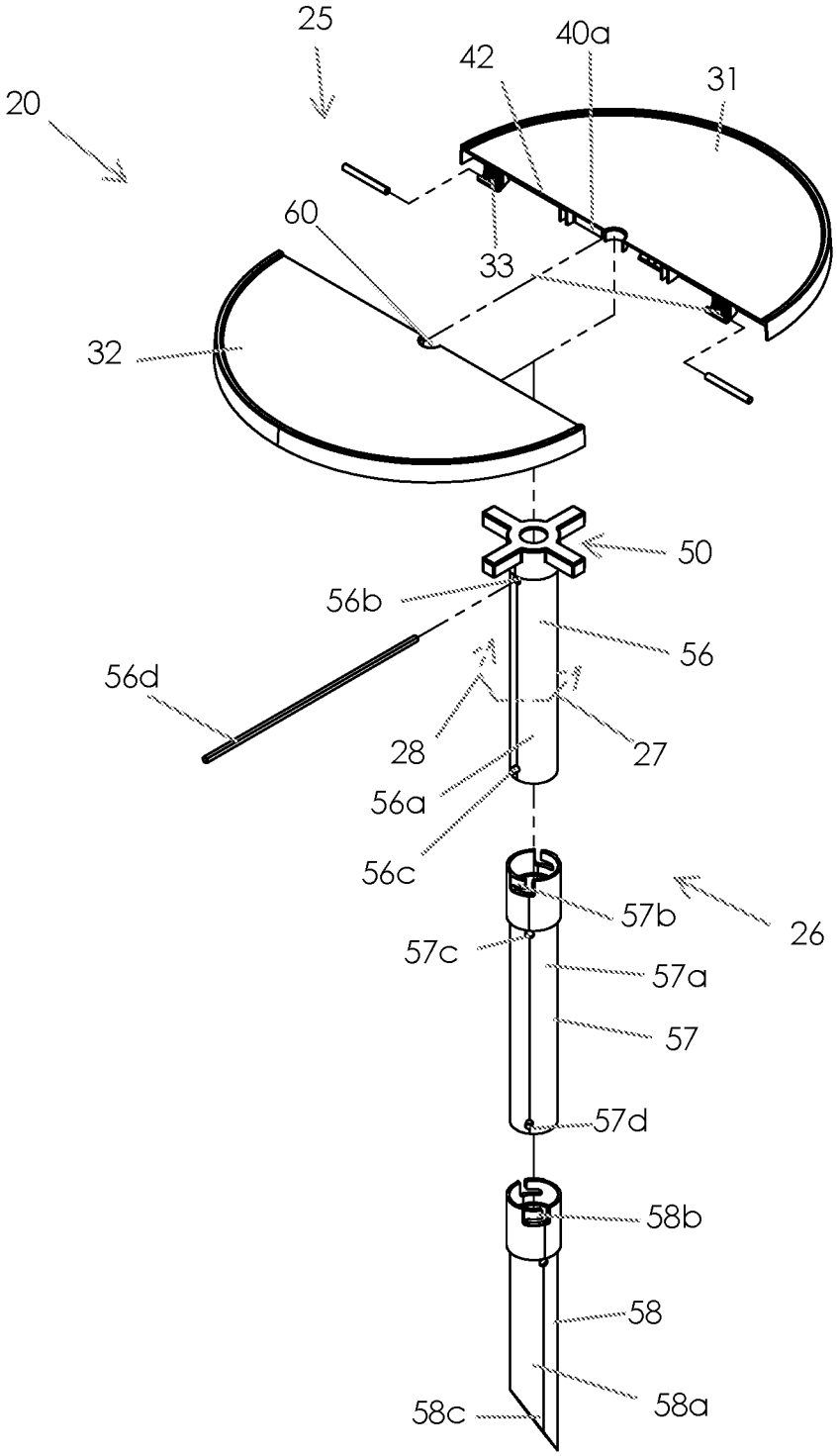
FIG. 6 is an exploded view of the adjustable beach table shown in FIG. 1.
Figure 7:
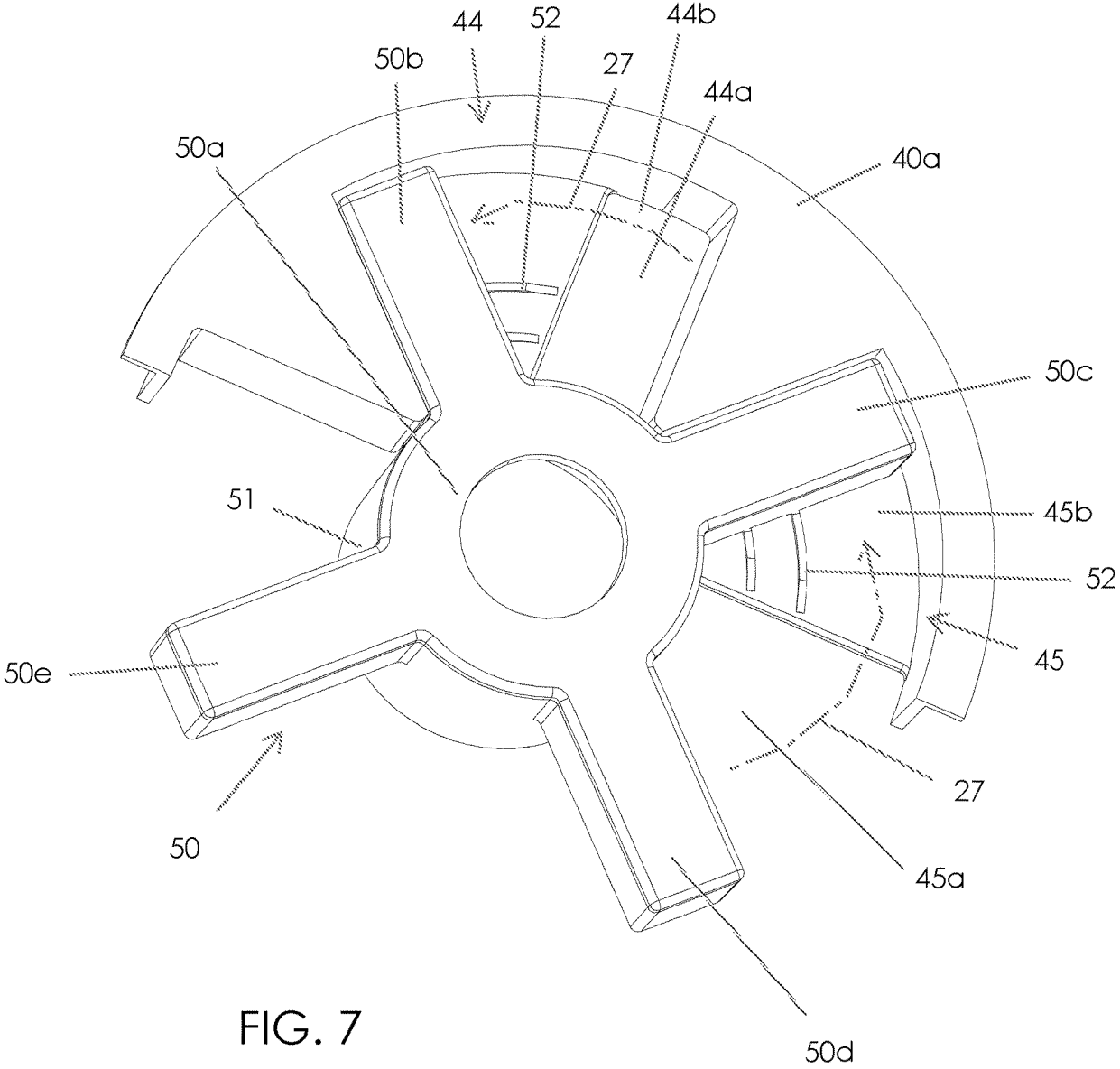
FIG. 7 is an enlarged perspective view of a first section of the first coupling engaged with a portion of the second coupling.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational and are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

The non-limiting exemplary embodiment(s) is/are referred to generally in FIGS. 1-8A and is/are intended to provide a collapsible and adjustable outdoor table 20 that is anchored into a sand surface and rotatably assembled/disassembled between unfolded/folded configurations 21, 22, respectively, without requiring tools. The bottom stabilizing assembly 26 of the outdoor table 20 can be partially submerged into the ground, sand, or gravel on land and under water. This bottom stabilizing assembly 26 can be made up of multiple interlocking parts to change the height of the outdoor table 20. Each part can be assembled by hand and allows rotatable connection to interchangeable top surface assemblies 25. A single bottom stabilizing assembly 26 can have one top surface assembly 25. Alternately, multiple bottom stabilizing assemblies 26 can be used for multiple larger top surface assemblies 25. Advantageously, outdoor table 20 does not require tools to assemble/disassemble.

In a non-limiting exemplary embodiment, the bottom stabilizing assembly 26 can be used for multiple items including, but not limited to, top surface assembly 25, chairs, coolers, beds, umbrellas, and trash cans. The bottom stabilizing assembly 26 can be broken down to make it more compact for storage. The top surface assembly 25 can be folded by hand to make it more compact for storage. The top surface assembly 25 has a raised edge to allow different accessories to be attached to it. Also, the bottom stabilizing assembly 26 can be broken down or extended to accommodate different heights as needed.

A non-limiting exemplary embodiment(s) of the present disclosure is referred to generally in FIGS. 1-8A and is intended to provide a specially configured collapsible and adjustable outdoor table 20 that is anchored into a sand surface and succinctly assembled/disassembled between unfolded/folded configurations 21, 22, respectively, without requiring tools. It should be understood that the exemplary embodiment(s) may be used to anchor the outdoor table 20 to a variety of sand surfaces and should not be limited to any particular sand surface described herein.

Referring to FIGS. 1-8A in general, in a non-limiting exemplary embodiment(s), the folding outdoor table 20 has a variable height bottom stabilizing assembly 26 configured for the beach or soft sand. Advantageously, bottom stabilizing assembly 26 can disassemble into smaller pieces which can be assembled by hand without the use of tools. Accessories may be added such as larger outdoor table tops, umbrellas, trash bag hook, cup holder, phone holder, etc. The outdoor table 20 can be folded and is sturdy enough to act as a second anchor for boats. Thus, a boat can be moored to the outdoor table 20. The outdoor table 20 provides variable height bottom stabilizing assembly 26 meant for the beach, river, grass, or soft sand.

Advantageously, the outdoor table 20 is broken down by hand without the need for tools. A user can extend/retract the height by adding more leg sections to the bottom stabilizing assembly 26. Advantageously, outdoor table 20 is sturdy enough to act as a second anchor for boats twenty-four feet and below while at the beach/shoreline/sandbar. Outdoor table 20 can sustain wake waves as well and is small enough to be stored in a small bag.

Referring to FIGS. 1-8A in general, the collapsible and adjustable outdoor table 20 is anchored into a sand surface and rotatably assembled/disassembled between unfolded/folded configurations 21, 22, respectively, without requiring tools. The collapsible outdoor table 20 includes a top surface assembly 25, and a bottom stabilizing assembly 26 removably and rotatably attached to a bottom face 30*b* of the top surface assembly 25. Advantageously, the bottom stabilizing assembly 26 has an adjustable vertical length and is configured to rotatably anchor into a sand surface such that the top surface assembly 25 is maintained at a substantially stable horizontal orientation relative to the adjustable vertical length. Advantageously, without requiring tools (e.g., wrench, power drill, pliers, screw driver, socket wrench, hammer, etc.), the top surface assembly 25 is configured to be rotatably assembled and rotatably disassembled to the bottom stabilizing assembly 26. Advantageously, the bottom stabilizing assembly 26 is configured to be rotatably locked in a first rotating direction 27 to the top surface assembly 25.

Advantageously, the bottom stabilizing assembly 26 is configured to be rotatably unlocked in a second rotating direction 28 to the top surface assembly 25. Advantageously, the first rotating direction 27 (e.g., counter clockwise) is opposite to the second rotating direction 28 (e.g., clockwise). Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the top surface assembly 25 includes a top surface 30 bifurcated into a first half 31 and a second half 32 and having a central aperture 60 at a junction 42 of the first half 31 and the second half 32, a plurality of hinges 33 connected to the bottom face 30*b* of the first half 31 and the second half 32, respectively, and a first coupling 40 statically connected the bottom face 30*b* of the top surface assembly 25. Advantageously, the first coupling 40 is bifurcated into a first section 40*a* and a second section 40*b* statically affixed to the first half 31 and the second half 32, respectively. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, each of the first section 40*a* and the second section 40*b* has a semi-spherical shape and conjoined to each other at junction 42 of the first half 31 and the second half 32. The first section 40*a* and second section 40*b* are mirror images of each other and coextensively shaped. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the bottom stabilizing assembly 26 includes a second coupling 50 operably engaged with the first coupling 40. Advantageously, the first section 40*a* and first half 31 (as a group) as well as the second section 40*b* and second half 32 (as a group) are configured to be synchronously pivotal relative to each other when the first coupling 40 is rotatably unlocked from the second coupling 50. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the second coupling 50 includes a central circular region 50*a* and a plurality of rectilinear flanges 50*b*-50*e* radially extended away from the central circular region 50*a*. Advantageously, the rectilinear flanges 50*b*-50*e* are equidistantly spaced apart along a circumferential outer perimeter 51 of the central circular region 50*a*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the hinges 33 are spaced along junction 42 of the first half 31 and the second half 32. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the first coupling 40 includes a plurality of quadrants 44-47 having a plurality of open bottom sides 44*a*-47*a*, respectively, and a plurality of friction-inducing regions 44*b*-47*b* contiguously disposed to the open bottom sides 44*a*-47*a*, respectively. Advantageously, the rectilinear flanges 50*b*-50*e* are configured to upwardly enter the first coupling 40 through the open bottom sides 44*a*-47*a*, respectively, and further configured to rotatably slide along a top face 52 of the friction-inducing regions 44*b*-47*b*, respectively, such that first coupling 40 is rotatably locked with the second coupling 50. An unlocking procedure is performed by oppositely rotating and downwardly disengaging the second coupling 50 through the open bottom sides 44*a*-47*a* of the first coupling 40. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the quadrants 44-47 include a first quadrant 44, a second quadrant 45, a third quadrant 46, and a fourth quadrant 47 equidistantly spaced apart from each other. Advantageously, the first quadrant 44 and the second quadrant 45 are located at the first section 40*a*. Advantageously, the third quadrant 46 and the fourth quadrant 47 are located at the second section 40*b*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the rectilinear flanges 50*b*-50*e* include a first rectilinear flange 50*b*, a second rectilinear flange 50*c*, a third rectilinear flange 50*d*, and a fourth rectilinear flange 50*e*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the friction-inducing regions 44*b*-47*b* include a first friction-inducing region 44*b*, a second friction-inducing region 44*c*, a third friction-inducing region 44*d*, and a fourth friction-inducing region 44*e*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the first rectilinear flange 50*b* is rotatably and removably interfitted with the first friction-inducing region 44*b*. Advantageously, the second rectilinear flange 50*c* is rotatably and removably interfitted with the second friction-inducing region 44*c*. Advantageously, the third rectilinear flange 50*d* is rotatably and removably interfitted with the third friction-inducing region 44*d*. Advantageously, the fourth rectilinear flange 50*e* is rotatably and removably interfitted with the fourth friction-inducing region 44*e*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the bottom stabilizing assembly 26 further includes a top rod 56 statically affixed to the second coupling 50, an intermediate rod 57 rotatably and detachably affixed to the top rod 56, and a bottom rod 58 rotatably and detachably affixed to the intermediate rod 57. Such a structural configuration yields the new, useful, and unexpected results of succinctly and rotatably assembling and disassembling the outdoor table 20 without the use of tools, which provides quick access to a sturdy outdoor table 20.

Figure 8:
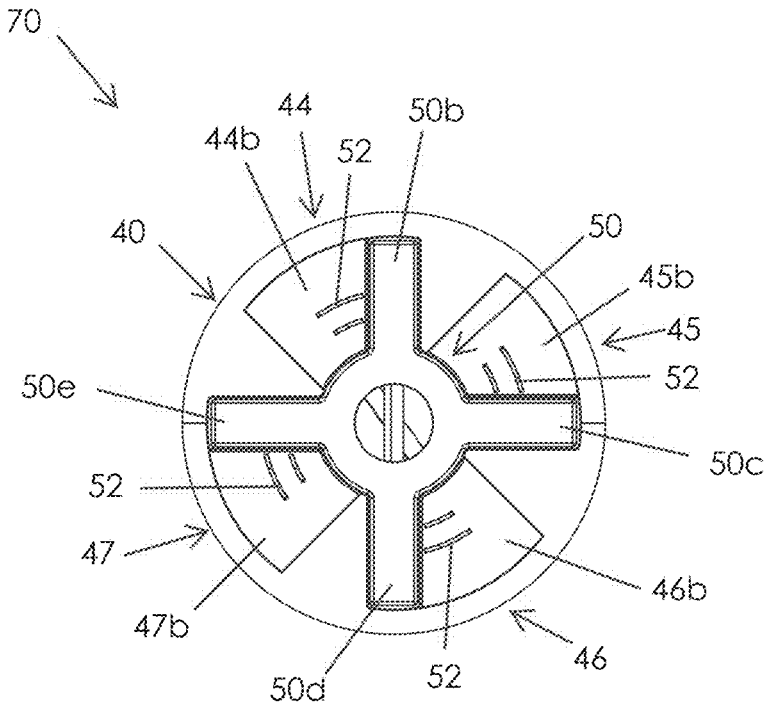
FIG. 8 is an enlarged top plan view showing the first coupling frictionally engaged with the second coupling at a locked position.
Figure 8A:
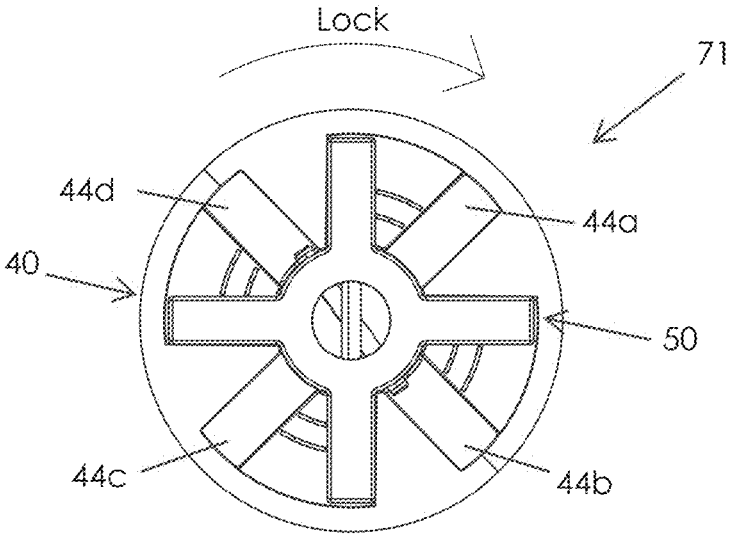
FIG. 8A is an enlarged top plan view showing the first coupling disengaged from the second coupling at an unlocked position.

In a non-limiting exemplary embodiment, the top rod 56 includes a first axial bore 56*a* centrally aligned with the central aperture 60, a pair of first apertures 56*b*, a pair of first fingers 56*c* protruding outwardly from the first axial bore 56*a*, and an elongated and rectilinear bar 56*d* removably passed through the first apertures 56*b*. The elongated and rectilinear bar 56*d* is used to help rotate the bottom stabilizing assembly 26 relative to the top surface assembly 25, thereby locking/unlocking such assemblies 25, 26 to each other without the use of tools. For example, while holding the rectilinear bar 56*d* at a fixed position, the bottom stabilizing assembly 26 remains stationary and the top surface assembly 25 is rotated in clockwise and counterclockwise directions thereby locking and unlocking the first coupling 40 to the second coupling 50 (visa versa), respectively (FIG. 8 illustrates and unlocked position 70, FIG. 8A illustrates a locked position 71). Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the intermediate rod 57 is rotatably connected to the top rod 56 and includes a second axial bore 57*a* vertically aligned with the first axial bore 56*a*, a pair of first J-shaped lock channels 57*b* located at a proximal end of the intermediate rod 57, a pair of second apertures 57*c* situated subjacent to the first J-shaped lock channels 57*b*, and a pair of second fingers 57*d* protruding outwardly from the second axial bore 57*a*. Advantageously, the first fingers 56*c* are rotatably engaged and disengaged with the first J-shaped lock channels 57*b*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the bottom rod 58 is rotatably connected to the intermediate rod 57 and includes a third axial bore 58*a* vertically aligned with the first axial bore 56*a*, a pair of second J-shaped lock channels 58*b* located at a proximal end of the bottom rod 58, and a tapered distal end 58*c*. Advantageously, the second fingers 57*d* are rotatably engaged and disengaged with the second J-shaped lock channels 58*b*. Such a structural configuration yields the new, useful, and unexpected results of succinctly and rotatably assembling and disassembling the outdoor table 20 without the use of tools, which provides quick access to a sturdy outdoor table 20.

In a non-limiting exemplary embodiment, the first half 31 and first section 40*a* (as a group) lays parallel to the second half 32 and second section 40*b* (as a group) when the top surface assembly 25 is articulated between folded position 22 and unfolded position 21. Such a structural configuration yields the new, useful, and unexpected results of succinctly and rotatably assembling and disassembling the outdoor table 20 without the use of tools, which provides quick access to a sturdy outdoor table 20.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A collapsible outdoor table comprising:

a top surface assembly; and a bottom stabilizing assembly removably and rotatably attached to said top surface assembly;

wherein said bottom stabilizing assembly has an adjustable vertical length and is configured to rotatably anchor into a sand surface such that said top surface assembly is maintained at a substantially stable horizontal orientation relative to said adjustable vertical length;

wherein, without requiring tools, said top surface assembly is configured to be rotatably assembled and rotatably disassembled to said bottom stabilizing assembly;

wherein said bottom stabilizing assembly is configured to be rotatably locked in a first rotating direction to said top surface assembly;

wherein said top surface assembly includes a support surface bifurcated into a first half and a second half and having a central aperture at a junction of said first half and said second half, a plurality of hinges connected to a bottom face of said first half and said second half, respectively, and a first coupling statically connected said bottom face of said bottom stabilizing assembly;

wherein said first coupling is bifurcated into a first section and a second section statically affixed to said first half and said second half, respectively;

wherein said bottom stabilizing assembly includes a second coupling operably engaged with said first coupling: wherein said first half and said second half are configured to be pivotal relative to each other when said first coupling is rotatably unlocked from said second coupling;

wherein said second coupling includes a central circular region and a plurality of rectilinear flanges radially extended away from said central circular region;

wherein said rectilinear flanges are equidistantly spaced apart along a circumferential outer perimeter of said central circular region.

2. The collapsible outdoor table of claim 1, wherein each of said first section and said second section has a semi-spherical shape and conjoined to each other at said junction of said first half and said second half.

3. The collapsible outdoor table of claim 1, wherein said first coupling includes a plurality of quadrants comprising: a first quadrant, a second quadrant, a third quadrant, and a fourth quadrant equidistantly spaced apart from each other; wherein said first quadrant and said second quadrant are located at said first section; wherein said third quadrant and said fourth quadrant are located at said second section.

4. The collapsible outdoor table of claim 1, wherein said rectilinear flanges comprise: a first rectilinear flange, a second rectilinear flange, a third rectilinear flange, and a fourth rectilinear flange.

5. The collapsible outdoor table of claim 4, further comprising: a plurality of friction-inducing regions contiguously disposed to said open bottom sides, respectively: wherein said friction-inducing regions include a first friction-inducing region, a second friction-inducing region, a third friction-inducing region, and a fourth friction-inducing region.

6. The collapsible outdoor table of claim 5, wherein said first rectilinear flange is rotatably and removably interfitted with said first friction-inducing region; wherein said second rectilinear flange is rotatably and removably interfitted with said second friction-inducing region; wherein said third rectilinear flange is rotatably and removably interfitted with said third friction-inducing region; wherein said fourth rectilinear flange is rotatably and removably interfitted with said fourth friction-inducing region.

7. The collapsible outdoor table of claim 1, wherein said bottom stabilizing assembly further comprises:

a top rod statically affixed to said second coupling;

an intermediate rod rotatably and detachably affixed to said top rod; and a bottom rod rotatably and detachably affixed to said intermediate rod.

8. The collapsible outdoor table of claim 7, wherein said top rod comprises:

a first axial bore centrally aligned with said central aperture;

a pair of first apertures;

a pair of first fingers protruding outwardly from said first axial bore; and an elongated and rectilinear bar removably passed through said first apertures.

9. The collapsible outdoor table of claim 8, wherein said intermediate rod is rotatably connected to said top rod and comprises:

a second axial bore vertically aligned with said first axial bore;

a pair of first J-shaped lock channels located at a proximal end of said intermediate rod;

a pair of second apertures situated subjacent to said first J-shaped lock channels; and a pair of second fingers protruding outwardly from said second axial bore;

wherein said first fingers are rotatably engaged and disengaged with said first J-shaped lock channels.

10. The collapsible outdoor table of claim 9, wherein said bottom rod is rotatably connected to said intermediate rod and comprises:

a third axial bore vertically aligned with said first axial bore;

a pair of second J-shaped lock channels located at a proximal end of said bottom rod; and a tapered distal end;

wherein said second fingers are rotatably engaged and disengaged with said second J-shaped lock channels.

11. The collapsible outdoor table of claim 1, wherein said first half lays parallel to said second half when said top surface assembly is articulated to a folded position and an unfolded position.

12. A collapsible outdoor table comprising:

a top surface assembly; and a bottom stabilizing assembly removably and rotatably attached to said top surface assembly;

wherein said bottom stabilizing assembly has an adjustable vertical length and is configured to rotatably anchor into a sand surface such that said top surface assembly is maintained at a substantially stable horizontal orientation relative to said adjustable vertical length;

wherein, without requiring tools, said top surface assembly is configured to be rotatably assembled and rotatably disassembled to said bottom stabilizing assembly;

wherein said bottom stabilizing assembly is configured to be rotatably locked in a first rotating direction to said top surface assembly;

wherein said bottom stabilizing assembly is configured to be rotatably unlocked in a second rotating direction to said top surface assembly;

wherein said top surface assembly includes a support surface bifurcated into a first half and a second half and having a central aperture at a junction of said first half and said second half, a plurality of hinges connected to a bottom face of said first half and said second half, respectively, and a first coupling statically connected said bottom face of said bottom stabilizing assembly;

wherein said first coupling is bifurcated into a first section and a second section statically affixed to said first half and said second half, respectively;

wherein said hinges are spaced along said junction of said first half and said second half;

wherein said first coupling includes a plurality of quadrants having a plurality of open bottom sides, respectively, and a plurality of friction-inducing regions contiguously disposed to said open bottom sides, respectively;

a plurality of rectilinear flanges being configured to upwardly enter said first coupling through said open bottom sides and further configured to rotatably slide along a top face of said friction-inducing regions, respectively, such that said first coupling is locked with said second coupling.

13. A collapsible outdoor table comprising:

a top surface assembly; and a bottom stabilizing assembly removably and rotatably attached to said top surface assembly;

wherein said bottom stabilizing assembly has an adjustable vertical length and is configured to rotatably anchor into a sand surface such that said top surface assembly is maintained at a substantially stable horizontal orientation relative to said adjustable vertical length;

wherein, without requiring tools, said top surface assembly is configured to be rotatably assembled and rotatably disassembled to said bottom stabilizing assembly;

wherein said bottom stabilizing assembly is configured to be rotatably locked in a first rotating direction to said top surface assembly;

wherein said bottom stabilizing assembly is configured to be rotatably unlocked in a second rotating direction to said top surface assembly;

wherein said first rotating direction is opposite to said second rotating direction;

wherein said top surface assembly includes a support surface bifurcated into a first half and a second half and having a central aperture at a junction of said first half and said second half, a plurality of hinges connected to a bottom face of said first half and said second half, respectively, and a first coupling statically connected said bottom face of said bottom stabilizing assembly;

wherein said first coupling is bifurcated into a first section and a second section statically affixed to said first half and said second half, respectively;

wherein said hinges are spaced along said junction of said first half and said second half;

wherein said first coupling includes a plurality of quadrants having a plurality of open bottom sides, respectively, and a plurality of friction-inducing regions contiguously disposed to said open bottom sides, respectively;

a plurality of rectilinear flanges being configured to upwardly enter said first coupling through said open bottom sides and further configured to rotatably slide along a top face of said friction-inducing regions, respectively, such that said first coupling is locked with said second coupling.

* * * * *